US010510334B1

(12) United States Patent
Olafsson et al.

(10) Patent No.: US 10,510,334 B1
(45) Date of Patent: Dec. 17, 2019

(54) PASSIVE EQUALIZATION FOR HEADPHONES

(71) Applicant: Onanoff Limited, Kowloon Bay (HK)

(72) Inventors: Petur Hannes Olafsson, Kowloon Bay (HK); Morgan Colmer, Tsimshatsui (HK)

(73) Assignee: ONANOFF LIMITED, Kowloon Bay (HK)

( * ) Notice: Subject to any disclaimer, the term of this patent is extended or adjusted under 35 U.S.C. 154(b) by 0 days.

(21) Appl. No.: 16/055,335

(22) Filed: Aug. 6, 2018

(51) Int. Cl.

| | |
|---|---|
| ***G10K 11/178*** | (2006.01) |
| ***H04R 1/28*** | (2006.01) |
| ***H04R 3/00*** | (2006.01) |
| ***H04R 5/033*** | (2006.01) |
| ***H04R 5/04*** | (2006.01) |

(52) U.S. Cl.
CPC ..... *G10K 11/17854* (2018.01); *H04R 1/283* (2013.01); *H04R 3/00* (2013.01); *H04R 5/033* (2013.01); *H04R 5/04* (2013.01)

(58) Field of Classification Search
CPC .... G10K 11/17854; H04R 1/283; H04R 3/00; H04R 5/033; H04R 5/04; H04R 3/04; H03G 5/165; H03G 5/025
See application file for complete search history.

(56) References Cited

U.S. PATENT DOCUMENTS

| | | | | |
|---|---|---|---|---|
| 3,870,834 | A * | 3/1975 | Yeaple | H04R 5/023 381/101 |
| 5,832,093 | A * | 11/1998 | Bernstein | A61B 7/04 381/67 |
| 8,254,621 | B2 | 8/2012 | Silvestri et al. | |
| 8,989,427 | B2 | 3/2015 | Silvestri et al. | |
| 9,215,522 | B2 | 12/2015 | Monahan et al. | |
| 9,621,979 | B2 | 4/2017 | Bakalos | |
| 9,794,681 | B2 | 10/2017 | Annunziato et al. | |
| 2005/0190930 | A1* | 9/2005 | Desiderio | H03G 5/04 381/103 |
| 2008/0152162 | A1* | 6/2008 | Bakalos | H04R 3/04 381/74 |
| 2010/0193221 | A1* | 8/2010 | Schoeffmann | H04R 1/1033 174/135 |
| 2015/0131809 | A1* | 5/2015 | Jones | H04R 1/1008 381/74 |
| 2015/0382096 | A1* | 12/2015 | Lamar | H04R 1/1041 381/74 |

FOREIGN PATENT DOCUMENTS

| | | |
|---|---|---|
| WO | 2008083148 | 7/2008 |

OTHER PUBLICATIONS

US 9,906,852, 02/2018, Bose Corporation, (withdrawn)

* cited by examiner

*Primary Examiner* — Andrew L Sniezek
(74) *Attorney, Agent, or Firm* — Gearhart Law, LLC

(57) ABSTRACT

A headphone apparatus and method of designing the apparatus, the apparatus having selectable EQ mode circuitry configured for listening to different types of audio signals. The EQ mode circuits comprise only passive circuit elements, and each is configured for listening to audio signals having a different characteristic sound profile. The EQ circuits can be switched in and out of the audio signal path to the headphone earpieces, using a switch selector. The selector is configured to operate the plurality of switches such that only a select one of them can be closed at a time.

5 Claims, 10 Drawing Sheets

PASSIVE EQUALIZATION FOR HEADPHONES

BACKGROUND

In the field of headphone design there is often a need to either create specific custom frequency responses, or to flatten the existing response of the headphone speaker driver. The usual techniques to achieve this are either to carefully design the transducer (headphone driver) to modify or flatten out the frequency response; or to add digital signal processor (DSP) technology to allow parametric EQ to be performed. Both of these techniques have significant disadvantages. For example, using only the design parameters available within the transducer as is usually done has several drawbacks, such as inability to adjust for variability in mass production. Moreover, there are limits on the frequency response changes it is possible to make without increasing the transducer cost to an unacceptable level. For the case of DSP equalization, there must be a power source available. This may not be an issue with headphones that already include a power source, such as headphones that include Bluetooth streaming functions. But for basic passive headphones, adding the cost of DSP processing and a power source is generally also unacceptable.

SUMMARY

A headphone apparatus and method of designing the apparatus, the apparatus having selectable EQ mode circuitry configured for listening to different types of audio signals. The EQ mode circuits comprise only passive circuit elements, and each is configured for listening to audio signals having a different characteristic sound profile. The EQ circuits can be switched in and out of the audio signal path to the headphone earpieces, using a switch selector. The selector is configured to operate the plurality of switches such that only a select one of them can be closed at a time.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate disclosed embodiments and/or aspects and, together with the description, serve to explain the principles of the invention, the scope of which is determined by the claims.

In the drawings.

DETAILED DESCRIPTION

Figure 1:
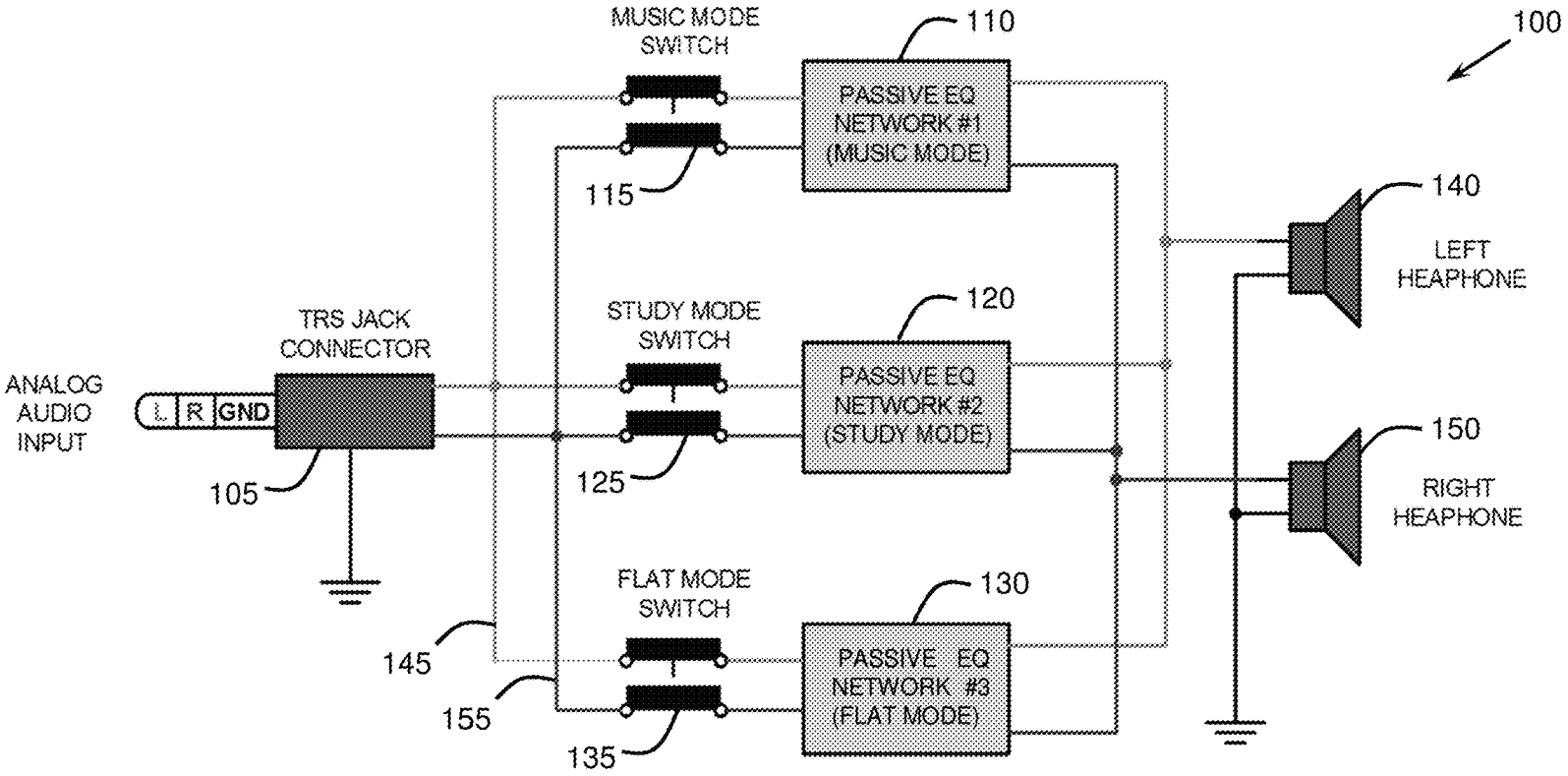
FIG. 1 is a block diagram of an exemplary headphone configuration having with switched EQ circuits, in accordance with the disclosure.

It is to be understood that the figures and descriptions provided herein may have been simplified to illustrate aspects that are relevant for a clear understanding of the herein described processes, machines, manufactures, and/or compositions of matter, while eliminating, for the purpose of clarity, other aspects that may be found in typical devices, systems, and methods. Those of ordinary skill in the pertinent art may recognize that other elements and/or steps may be desirable and/or necessary to implement the devices, systems, and methods described herein. Because such elements and steps are well known in the art, and because they do not facilitate a better understanding of the present disclosure, a discussion of such elements and steps may not be provided herein. However, the present disclosure is deemed to inherently include all such elements, variations, and modifications to the described aspects that would be known to those of ordinary skill in the pertinent art.

It will be readily understood that the components of the present invention, as generally described and illustrated in the figures herein, may be arranged and designed in a wide variety of different configurations. Thus, the following detailed description of the method, apparatus, and system embodiments as represented in the attached figures is not intended to limit the scope of the invention as claimed, but is merely representative of exemplary embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

A variety of embodiments will now be described. These embodiments are provided as teaching examples and should not be interpreted to limit the scope of the invention. Although specific details of the embodiments are presented, these embodiments may be modified by changing, supplementing, or eliminating many of these details.

The embodiments disclosed herein use passive electronic circuits and devices to modify a headphone transducer's response to sound signals. This is achieved by creating frequency domain equalization to modify the sound perceived by the user. Passive electronic networks do not need any power other than the electronic audio signal that is delivered to the headphone unit by the playback device.

Moreover, several different equalization modes can be created within a headphone product, and switched in or out of the circuit as desired by the listener, to improve the perception of different sound recording types, such as a recording of a voice lecture, versus a recording of orchestral classical music, or loud rock music. Many types of switches can be used to select a preferred one of a plurality of equalization filters or "modes". For example, in an embodiment a rotary switch may be used to select 1-of-N equalization (EQ) modes, each mode designed to modify an audio signal in a distinctive way using passive circuit elements. Such passive equalization filters do not require a power supply. Because the types of components used (e.g., resistors and capacitors) are inexpensive and easy to obtain, the disclosed embodiments are also very commercially attractive, giving good performance for minimal cost.

Exemplary Equalization Modes

FIG. 1 is a block diagram of an exemplary headphone embodiment 100 in which there are three passive EQ circuits or "networks" of passive elements, called a music mode 110 (for listening to classical music), a study mode 120 (e.g., for listening to lectures), and a flat mode 130 (for listening to generic audio). Three switches, which may be combined into a single mechanism such as a rotary switch, can be used to by a user to select a desired one of the three modes. The switches include a music mode switch 115, a study mode switch 125, and a flat mode switch 135. Of course, in other embodiments, any number of additional and/or other passive networks and corresponding modes may be provided. The headphone apparatus comprises a so-called tip-ring-sleeve (TRS) connector 105 or the like, for plugging the headphone apparatus into an amplifier or the like, and left and right headphone transducer elements 140, 150. The TRS connector 105 and transducers 140, 150 are operatively coupled together by left and right circuits 145, 155, respectively. The music mode passive EQ network 110 is switched into the left and right circuits 145, 155, by closing music mode switch 115. The three switches 115, 125, 135 are constructed such that when any one of them is closed, the other two must be open. Thus, the music mode network 110 is switched into the left and right circuits 145, 155, when the music mode switch 115 is closed, and the study mode switch 125 and the flat mode switch 135 are kept open. The study mode network 120 is switched into the left and right circuits 145, 155, when the study mode switch 125 is closed, and the music mode switch 115 and the flat mode switch 135 are kept open. Finally, the flat mode network 130 is switched into the left and right circuits 145, 155, when the flat mode switch 135 is closed, and the music mode switch 115 and the study mode switch 125 are kept open.

In the following exemplary modes, the analysis is described mathematically in terms of Laplace transforms using the complex variable s. The complex frequencies defined by s are mapped with the following equation:

$$s=\sigma+j\omega$$

where σ is the real component and jω is the imaginary component of points on the imaginary plane. Using this notation, frequencies are expressed as radians per second, and are related to frequency in Hertz (Hz) via the following equation:

$$\omega=2\pi f$$

In the analysis that follows, a mode frequency response graph shows how the unmodified frequency response of particular types or classes of audio recordings or programming should be modified to produce a desired effect for each of those types. In the exemplary embodiment, the same three example EQ modes disclosed in the foregoing have the following Laplace representations, and will produce equalization curves that match the desired frequency responses for those modes.

$$H_{(s)}EQ=\begin{cases} g_m\cdot\left[\left(\frac{\omega_4}{\omega_3}\cdot\frac{s+\omega_3}{s+\omega_4}\right)+\frac{s}{s+\omega_5}\right] \\ g_s\cdot\left[\frac{1}{s+\omega_2}\cdot\frac{s}{s+\omega_1}\right] \\ g_f \end{cases}$$

A limitation of using purely passive equalization is that it is only possible to realize first order pole-zero structures using passive elements. However, these can be combined if desired to form more complex structures.

Study Mode

The purpose of study mode to allow a user to listen to audio content that has a predominantly spoken word content. The function of this mode to remove as much other distracting noise as possible, thereby emphasizing the vocal content of the media. The sound profile of typical voice-based content is in the so-called mid-range frequencies. Accordingly, an appropriate mode for this content would filter out low- and high-frequency sound, but not mid-range frequencies, thereby emphasizing the vocal content.

Figure 2A:
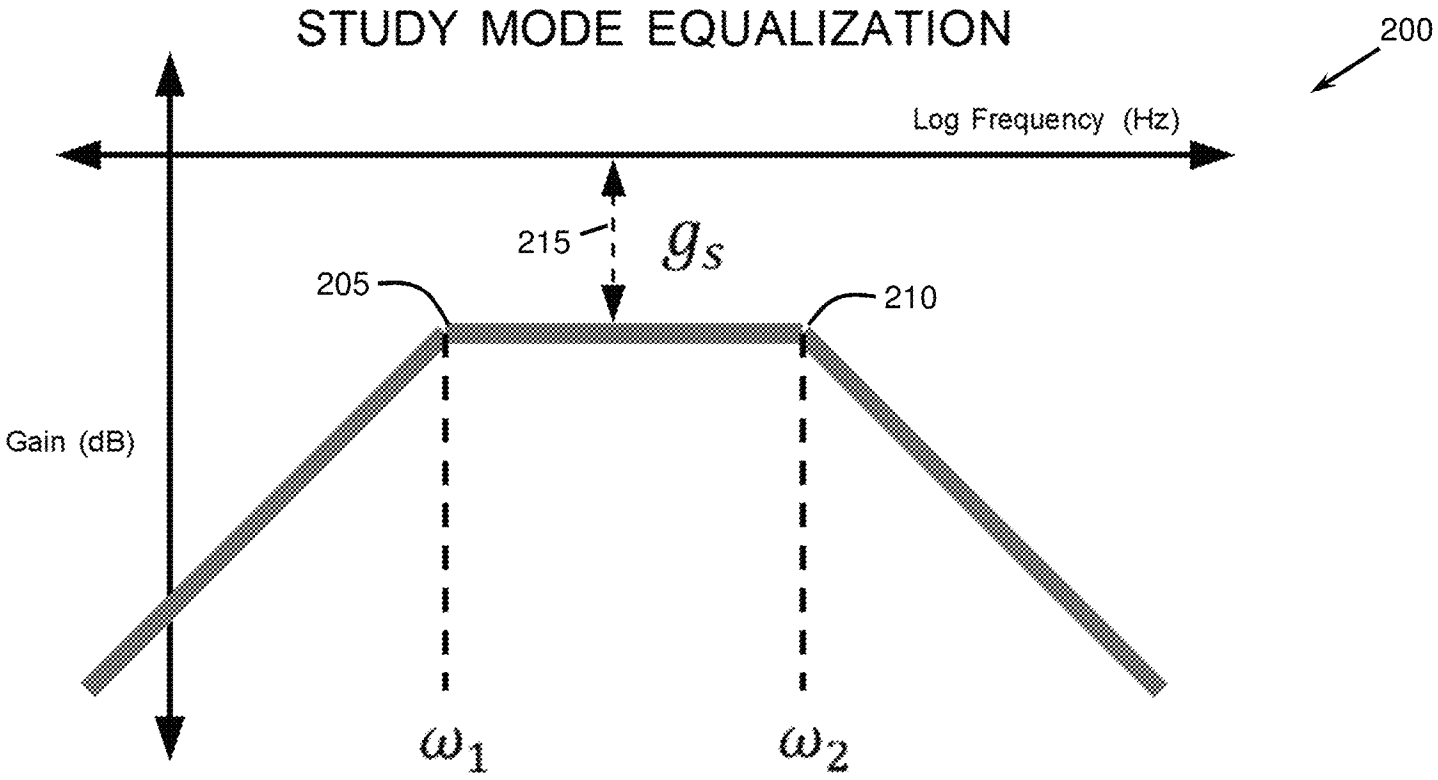
FIGS. 2A and 3A are exemplary equalization curves for use in emphasizing particular frequency ranges in different types of audio signals, in accordance with the disclosure.

FIG. 2A shows such an exemplary equalization curve 200, useful for emphasizing vocal content. The critical frequencies $\omega_1$ 205 and $\omega_2$ 210 defining a frequency range it is desired to emphasize, and a desired gain $g_s$ 215 within that range, are shown on the diagram. This equalization curve can be produced using a combination of a first order high-pass and a first order low-pass filter cascaded together. This results in the block diagram shown in FIG. 2B for this particular EQ mode. In the figure, input 220 receives a sound signal and feeds the signal into high pass filter 225, which suppresses frequencies below $\omega_1$ 205. The signal with low frequencies suppressed is then fed into low pass filter 230, which suppresses frequencies above $\omega_2$ 210. The resulting signal is then provided to a gain matching element 235 which adjusts the filtered signal to produce the desired gain $g_s$ in the frequency range being emphasized before the signal is fed to output 240.

Figure 2B:
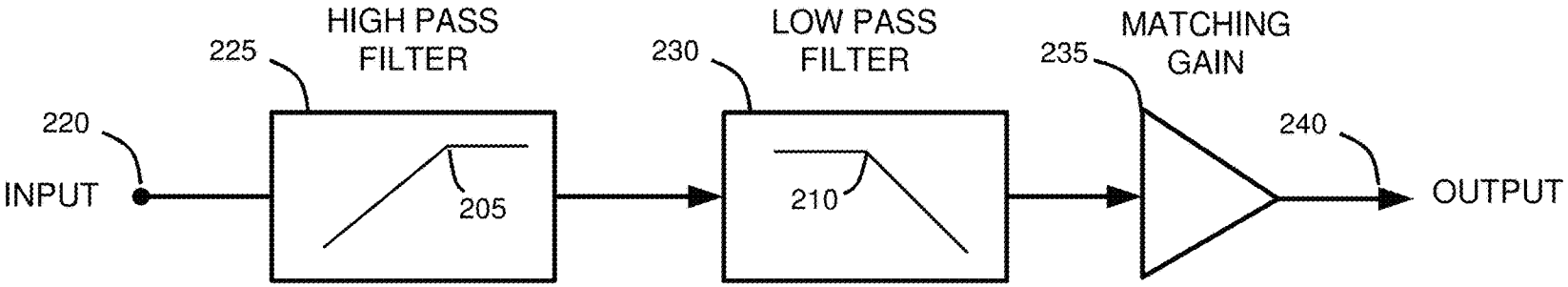
FIGS. 2B and 3B are exemplary block diagrams with functional blocks designed to effect the equalization curves of FIGS. 2A and 3A, respectively, in accordance with the disclosure.
Figure 2C:
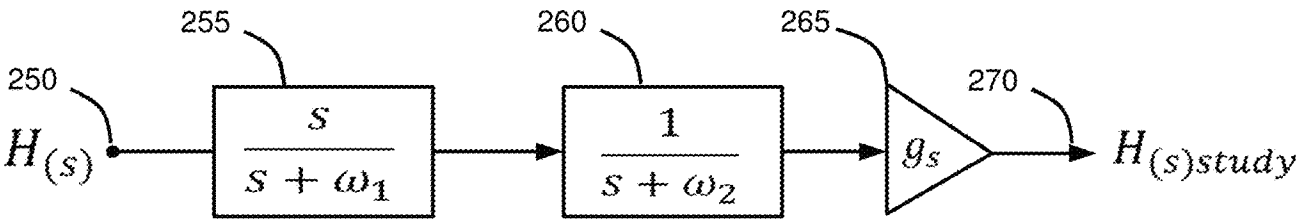
FIGS. 2C and 3C are exemplary mathematical relationships in the Laplace domain representing the functional blocks of FIGS. 2B and 3B, respectively, in accordance with the disclosure.

From the block diagram FIG. 2B, the required mathematical relationships in the Laplace domain can be evaluated to realize a physical implementation for this EQ mode. To do so, the blocks are evaluated as Laplace equations using their equivalence to differential equations. For example, resistor and capacitor (RC) circuits can be first evaluated as differential equations, and then apply the Laplace transform. The transfer diagram equivalent to the block diagram in FIG. 2B is shown in FIG. 2C. In the figure, input 250 receives an original signal $H_{(s)}$ and feeds it into high pass block 255, which suppresses frequencies below $\omega_1$ 205. The signal with low frequencies suppressed is then fed into low pass block 260, which suppresses frequencies above $\omega_2$ 210. The resulting signal is then provided to element 265 which adjusts the filtered signal to produce the desired gain $g_s$ in the frequency range being emphasized, before the signal is fed to output 270. The output signal $H_{(s)study}$ is basically just the input signal $H_{(s)}$ modified in accordance with the desired sound profile of FIG. 2A. From the diagram of FIG. 2C, the complete equation for this EQ mode is as follows.

$$H_{(s)study} = g_s \cdot \left[\frac{1}{s+\omega_2} \cdot \frac{1}{s+\omega_1}\right]$$

Figure 2D:
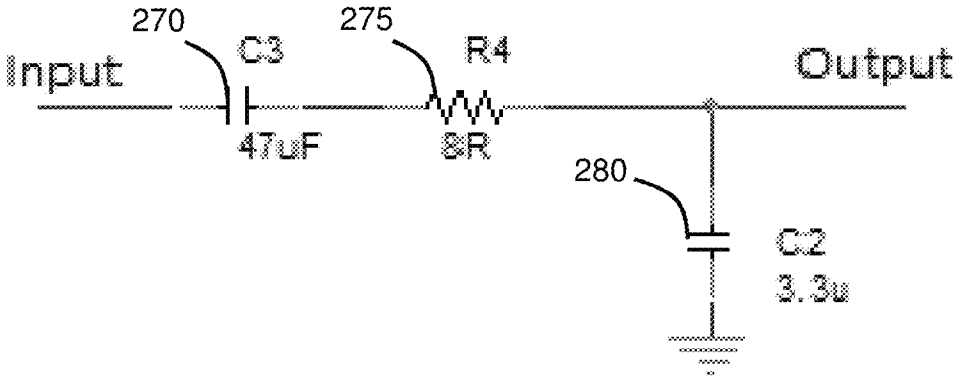
FIGS. 2D and 3D are schematic diagrams of exemplary circuits that realize the mathematical relationships shown in FIGS. 2C and 3C, respectively, in accordance with the disclosure.

From this equation a passive circuit can be designed that will implement the EQ mode as a realizable circuit. The components may be selected based upon the required transfer function that corresponds to the desired frequency domain shape. FIG. 2D is a schematic diagram of such a circuit, where the values of the passive elements C3 270, R4 275, and C2 280 are chosen to produce the desired $\omega_1$ 205, $\omega_2$ 210, and $g_s$ 215.

Music Mode

Figure 3A:
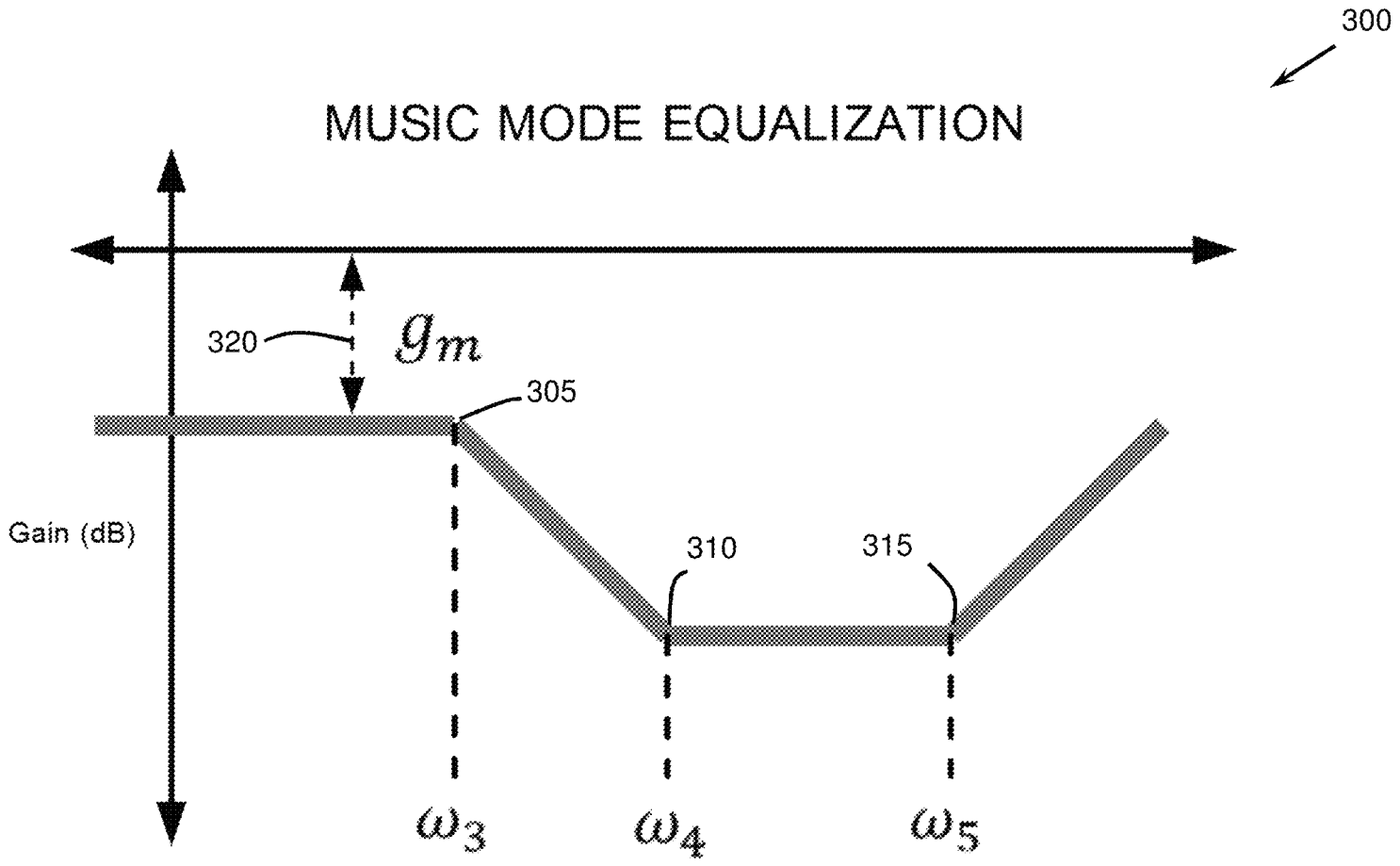
Figure 3B:
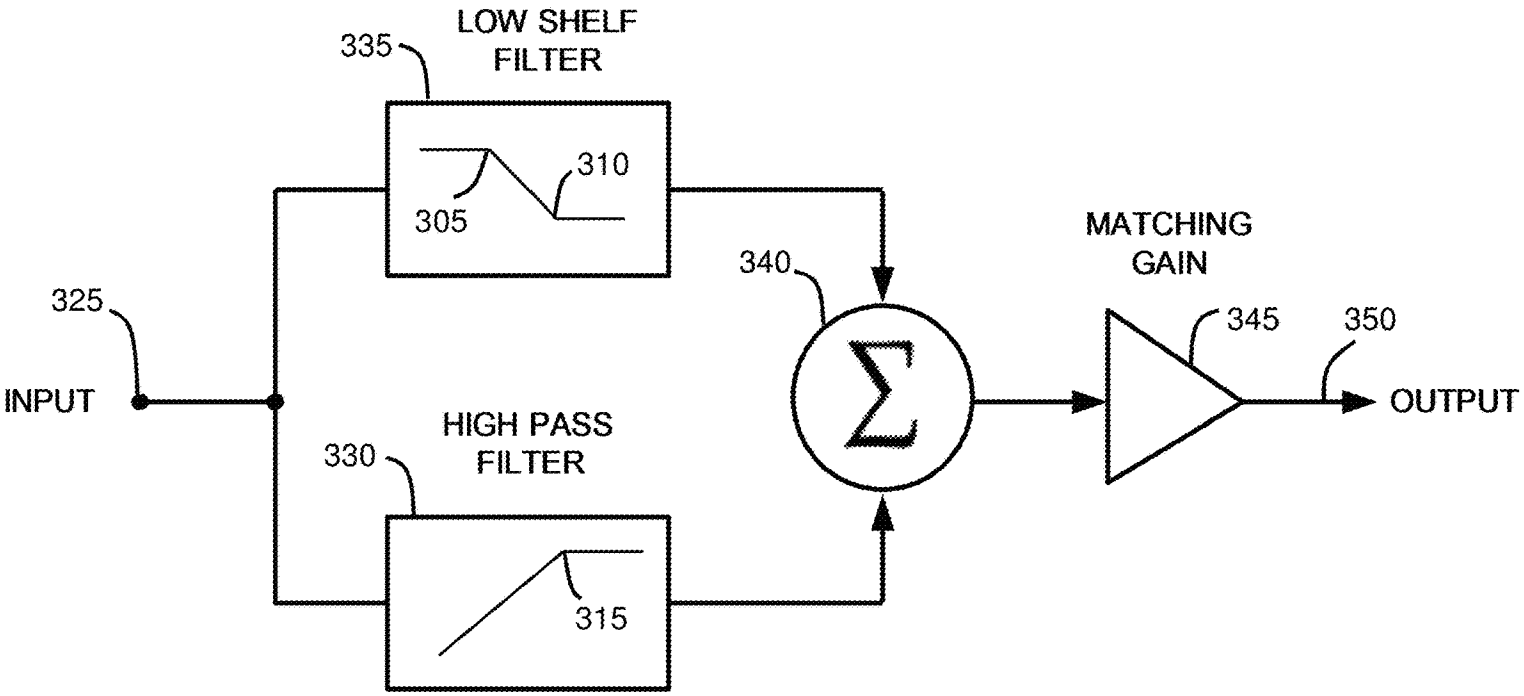

Music mode is intended to improve the sound of music being played. The small sized transducers generally used in headphones are not very good at reproducing low frequencies. However, when the transducers have been optimized for low frequency performance, the high frequency performance may be degraded. The music mode EQ profile 300 is therefore designed to emphasize both the low frequency and the high frequency parts of the audio spectrum, as shown in FIG. 3A. Here, the frequency $\omega_3$ 305 is the top of the audio frequency range considered to be the "low frequency" range being emphasized. The frequencies $\omega_4$ 310 and $\omega_5$ 315 define a range it is desired to de-emphasize (i.e., suppress), thereby emphasizing the low frequency range by comparison. High frequencies above $\omega_5$ 315 can remain essentially unmodified except for application of a desired gain factor $g_m$ 320. This factor may be selected to produce the low frequency response desired. An illustrative block diagram corresponding to this profile is shown in FIG. 3B.

In the figure, input 325 receives a sound signal and feeds the signal into two filters connected in parallel, a high pass filter 330, and a low shelf filter 335. The high pass filter 330 suppresses frequencies below $\omega_5$ 315, but not frequencies above that value. The low shelf filter 335 reduces the gain of frequencies $\omega_4$ 310 and above to a select degree. The two post-filter signals are added together in adder 340. The resulting signal is then provided to a gain matching element 345 which adjusts the filtered signal to produce the desired gain $g_m$ in the low frequency range being specifically emphasized by design, before the signal is fed to output 350.

Figure 3C:
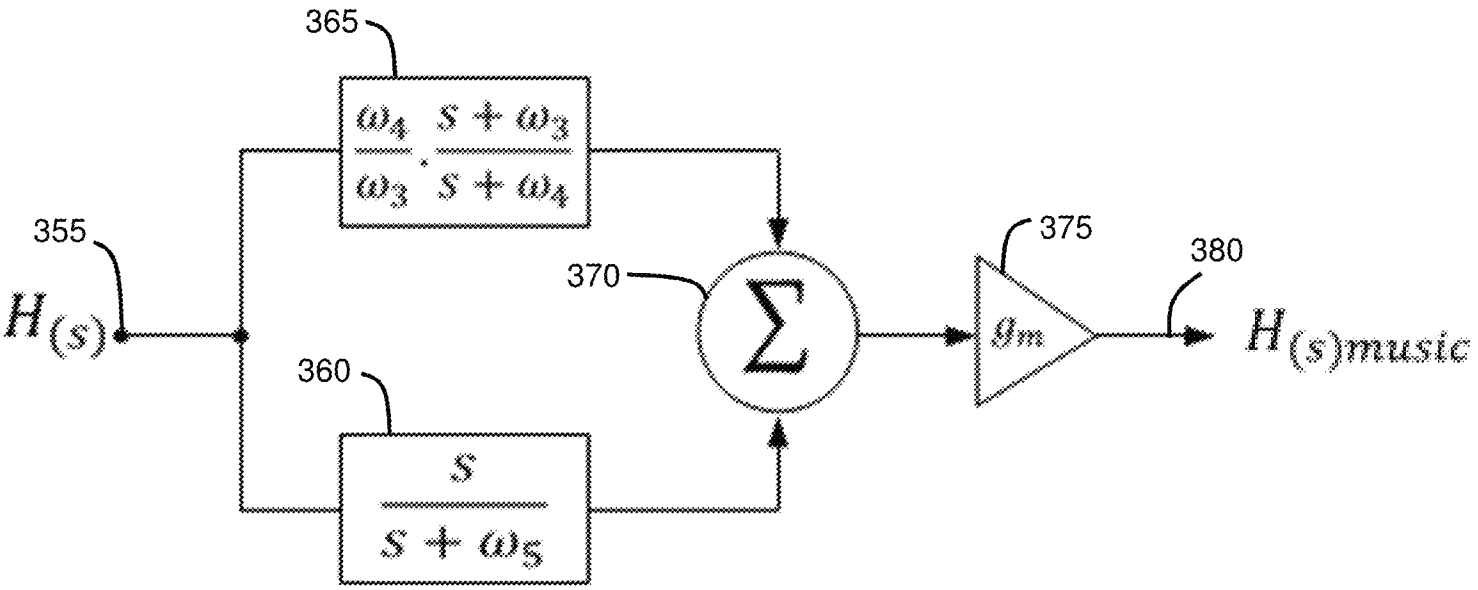

From the block diagram 3B, as before, the required mathematical relationships in the Laplace domain can be evaluated to realize a physical implementation for this EQ mode. The transfer diagram equivalent to the block diagram in FIG. 3B is shown in FIG. 3C. In the figure, input 355 receives an original music signal $H_{(s)}$ and feeds it into two blocks connected in parallel. One is high pass block 360, which suppresses frequencies below $\omega_5$ 315. The other is low shelf block 365, which de-emphasizes frequencies $\omega_4$ 310 and above to a select degree. The signals from these two filters are added together at adder 370. The resulting signal is then provided to element 375 which adjusts the combined signal to produce the desired gain $g_m$ in the frequency range below $\omega_3$ 305, being emphasized by design. The signal is then fed to output 380. The output signal $H_{(s)music}$ is basically just the input signal $H_{(s)}$ modified in accordance with the desired sound profile of FIG. 3A. From the diagram of FIG. 3C, the complete equation for this EQ mode is:

$$H_{(s)music} = g_m \cdot \left[\left(\frac{\omega_4}{\omega_3} \cdot \frac{s+\omega_3}{s+\omega_4}\right) + \frac{s}{s+\omega_5}\right]$$

Figure 3D:
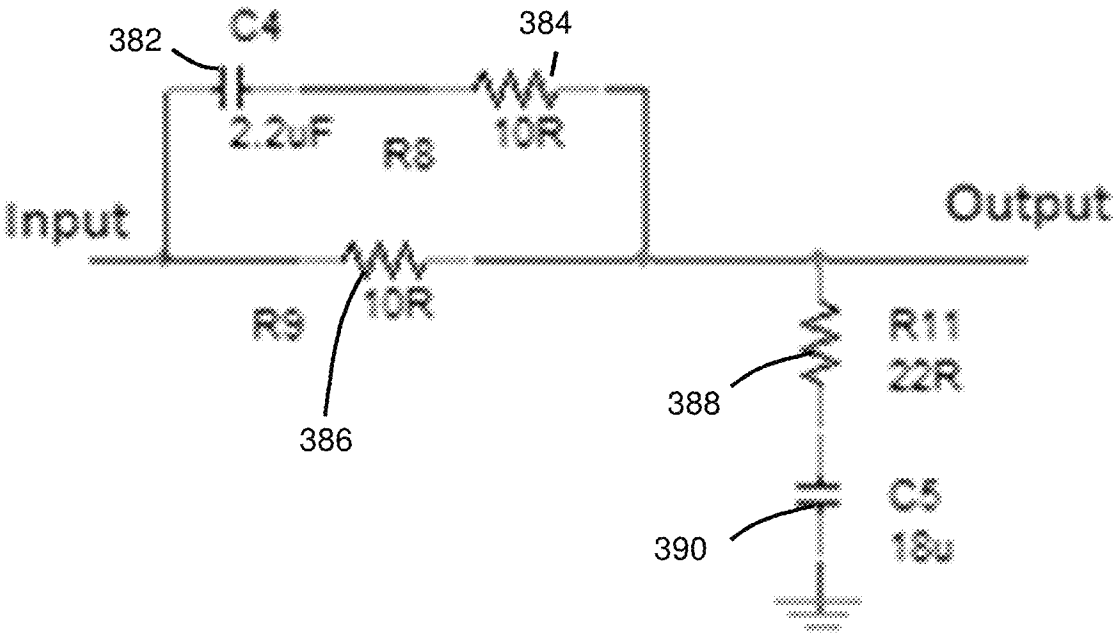

From this equation a passive circuit can be designed that will implement the EQ mode as a realizable circuit. A schematic diagram of such a circuit is shown in FIG. 3D, where the values of the passive elements C4 382, R8 384, R98 386, R11 388, and C5 390 are chosen to produce the desired $\omega_3$ 305, $\omega_4$ 310, $\omega_5$ 315, and $g_m$ 320.

Flat Mode

Figure 4A:
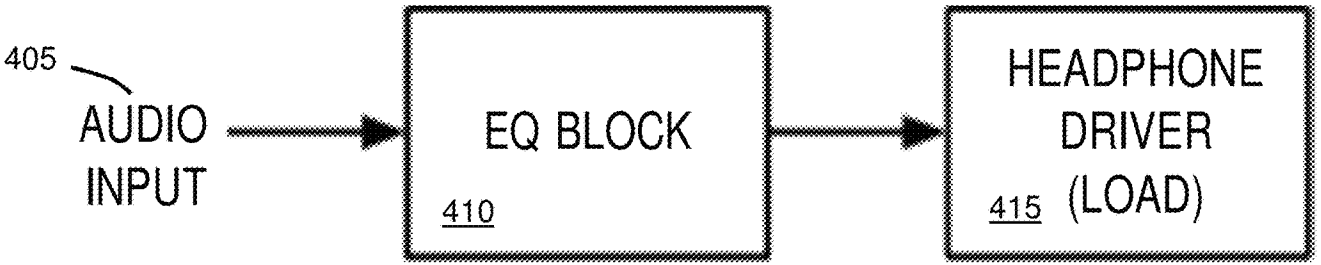
FIGS. 4A and 4B show an exemplary flat equalization curve block diagram and circuit, respectively, in accordance with the disclosure.
Figure 4B:
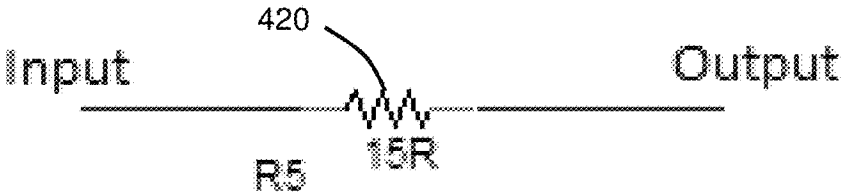

Flat mode, as the name suggests, does not attempt to apply an equalization curve, but simply attempts to reduce the gain to match the other modes in terms of overall sound levels. An illustrative block diagram corresponding to a flat profile is shown in FIG. 4A. In the figure, an audio input 405 is feed to EQ block 410 to adjust the signal gain to mimic the overall gain of the other modes. The adjusted signal is then sent to the headphone driver 415, such as the pair of transducers 140, 150 of FIG. 1. As shown in FIG. 4B, this may be implemented as a single resistor 420, the value of which may be determined from a gain matching analysis, as follows.

Gain Matching

Gain matching is needed to ensure that all filters are designed so that none of them need to exceed 0 dB levels, which is impossible to implement with a passive equalization system. In the analysis, the complex impedance of the transducer needs to be taken into account.

The transducer can be acceptably modeled as a resistive load in series with an inductive load, where the values of the resistance and the inductance can be measured on each transducer. Once the transfer function has been evaluated, the overall gain can be adjusted by adjusting the ratio of the resistors and capacitors values, together achieving the required insertion impedance. For a given $w_0=1/(RC)$, the relative ratios of the Rs and Cs can be adjusted to give a wide range of values for the desired series impedance. For example if a given break frequency is $w_0=1000$ rads/sec, then an RC circuit of 10 ohms and 100 uF can be arranged. If the impedance is needed to be higher, the resistance can be increased to 100 ohms and the capacitance can be reduced to 10 uF and still achieve the same 1000 rads/sec break frequency, but having a different impedance.

Figure 5:
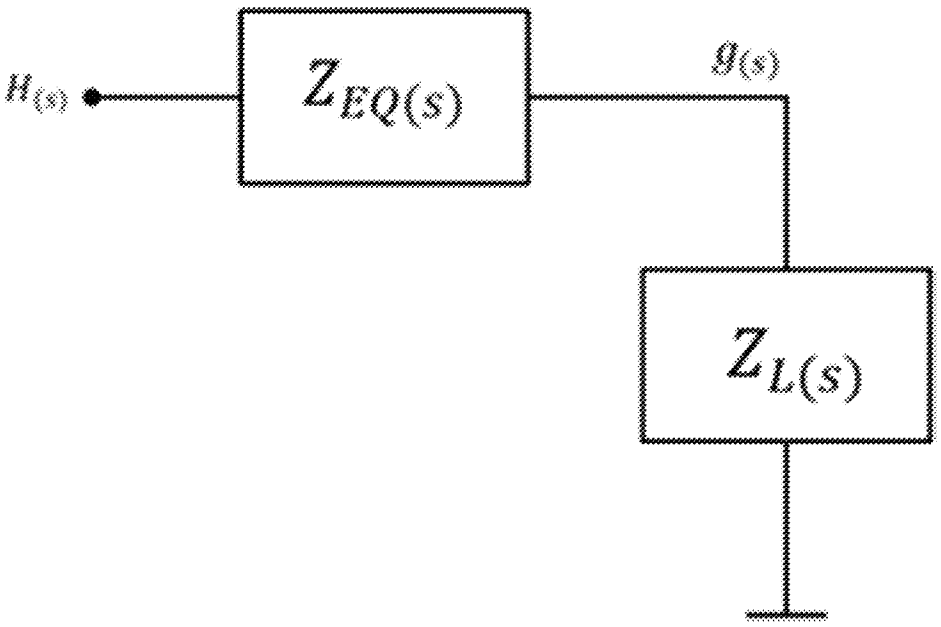
FIG. 5 is an exemplary block diagram for determining an equalization curve gain factor, in accordance with the disclosure.

Using these values for the load model $Z_{L(s)}$, the composite model shown in FIG. 5 can be derived for each of the EQ mode models $Z_{EQ(s)}$. From the composite models, the gain needed in each of the EQ modes can be determined in accordance with the following:

$$g_{(s)} = \frac{Z_{L(s)}}{Z_{EQ(s)} + Z_{L(s)}}$$

Based on this relationship, the complex impedance of each of the EQ modes can be scaled to produce the desired gain.

Although the invention has been described and illustrated in exemplary forms with a certain degree of particularity, it is noted that the description and illustrations have been made by way of example only. Numerous changes in the details of construction, combination, and arrangement of parts and steps may be made without deviating from the scope of the invention. Accordingly, such changes are understood to be inherent in the disclosure. The invention is not limited except by the appended claims and the elements explicitly recited therein. The scope of the claims should be construed as broadly as the prior art will permit. It should also be noted that all elements of all of the claims may be combined with each other in any possible combination, even if the combinations have not been expressly claimed.

What is claimed is:

1. A headphone apparatus having selectable passive EQ mode circuitry configured for listening to different types of audio signals, comprising:

a tip-ring-sleeve (TRS) connector for plugging into an audio signal source and providing a left audio channel to a left circuit and a right audio channel to a right circuit;

a left earpiece having a left transducer operatively coupled to the left circuit;

a right earpiece having a right transducer operatively coupled to the right circuit;

a plurality of passive EQ networks, each configured for listening to audio signals having a different characteristic sound profile, wherein:

the plurality of passive EQ networks includes an EQ network suitable for listening to spoken voice content, and the EQ network for listening to spoken voice content has a Laplace representation equal to $$H_{(s)study} = g_s \cdot \left[\frac{1}{s+\omega_2} \cdot \frac{1}{s+\omega_1}\right],$$

wherein:

$H_{(s)study}$ is an output signal resulting from modifying an input signal corresponding to the spoken voice content in accordance with the sound profile, $g_s$ is a desired gain factor within a frequency range from $\omega_1$ to $\omega_2$, and $s=\sigma+j\omega$, where $\sigma$ is a real component, $\omega=2\pi f$, and $j\omega$ is an imaginary component of points on an imaginary plane;

a plurality of switches, each switch operatively coupled to a respective one of the passive EQ networks, configured to connect that passive EQ network into the left and right circuits between the TRS connector and the transducers; and a switch selector configured to operate the plurality of switches such that only a select one of the switches connects its passive EQ network into the left and right circuits.

2. The headphone apparatus of claim 1, wherein the plurality of passive EQ networks further includes an EQ network suitable for listening to music content.

3. The headphone apparatus of claim 2, wherein the EQ network for listening to music content has a Laplace representation equal to $$H_{(s)music} = g_m \cdot \left[\left(\frac{\omega_4}{\omega_3} \cdot \frac{s+\omega_3}{s+\omega_4}\right) + \frac{s}{s+\omega_5}\right],$$

wherein:

$H_{(s)music}$ is another output signal resulting from modifying another input signal corresponding to music content in accordance with the sound profile, $\omega_3$ is a frequency at a top of a low frequency range between $\omega_4$ and $\omega_5$, and $\omega_5$ is modified by $g_m$, another desired gain factor selected to produce a low frequency response.

4. The headphone apparatus of claim 1, wherein the switch selector is a rotary switch selector.

5. The headphone apparatus of claim 1, wherein the switch selector is a sliding linear switch selector.

* * * * *